US010774561B2

(12) United States Patent
McIntosh

(10) Patent No.: US 10,774,561 B2
(45) Date of Patent: Sep. 15, 2020

(54) STAKE INSTALLATION TOOL

(71) Applicant: Edward McIntosh, Livonia, MI (US)

(72) Inventor: Edward McIntosh, Livonia, MI (US)

( * ) Notice: Subject to any disclaimer, the term of this patent is extended or adjusted under 35 U.S.C. 154(b) by 0 days.

(21) Appl. No.: 16/668,495

(22) Filed: Oct. 30, 2019

(65) Prior Publication Data

US 2020/0256079 A1 Aug. 13, 2020

Related U.S. Application Data

(60) Provisional application No. 62/803,394, filed on Feb. 8, 2019.

(51) Int. Cl.
*E04H 12/22* (2006.01)

(52) U.S. Cl.
CPC ..... *E04H 12/2215* (2013.01); *E04H 12/2292* (2013.01)

(58) Field of Classification Search
CPC ..... E04H 12/2215; E04H 12/2292
USPC ..... 52/DIG. 1
See application file for complete search history.

(56) References Cited

U.S. PATENT DOCUMENTS 3,519,234 A * 7/1970 Matson ..... E04H 12/2215 248/156
2002/0195273 A1* 12/2002 Collins ..... E04H 17/263 175/19
2003/0079891 A1* 5/2003 Layton, Jr. ..... E21B 11/005 173/30
2006/0241647 A1* 10/2006 Chen ..... E04H 17/263 606/100
2007/0033896 A1* 2/2007 Wasiukiewicz ..... G09F 7/22 52/834
2019/0380282 A1* 12/2019 Burshan ..... B25D 17/00

* cited by examiner

*Primary Examiner* — Patrick J Maestri
(74) *Attorney, Agent, or Firm* — MacMillan, Sobanski & Todd, LLC

(57) ABSTRACT

A stake installation tool may include a rod having a lower end and an opposed upper end, and a sleeve fixed to the rod around an outer surface of the upper end. The installation tool may also include a support tube having channel extending therethrough, with the sleeve mounted within the channel adjacent to an upper end of the support tube and fixed thereto, and with the rod extending through the channel and extending downward from a lower end of the support tube, creating a gap between the channel and the rod to receive a stake in the gap while the stake also extends downward from the lower end of the support tube on the rod. The installation tool may also include a handle mounted on top of the support tube.

14 Claims, 4 Drawing Sheets

STAKE INSTALLATION TOOL

CROSS-REFERENCE TO RELATED APPLICATIONS

The present application claims the benefit of U.S. Provisional Application No. 62/803,394, filed Feb. 8, 2019, the contents of which are incorporated herein by reference.

BACKGROUND OF THE INVENTION

The present invention relates to an installation tool, particularly useful for installing snow stakes.

Many commonly insert stakes partially into the ground to visually mark off areas. For example, one may use stakes to mark off areas to avoid when clearing snow. Such snow stakes may be partially inserted into the ground to mark off curbs along a street, the edge of driveways or sidewalks, sprinkler systems, or other areas. Often such stakes are flexible and can be broken if bent too far, thus making installation of the stakes more time consuming and difficult than desired. Holes can be dug to assist in installation, but this is also much more time consuming than is desired.

SUMMARY OF THE INVENTION

An embodiment contemplates a stake installation tool comprising: a rod having a lower end and an opposed upper end; a sleeve fixed to the rod around an outer surface of the upper end; and a support tube having channel extending therethrough, with the sleeve mounted within the channel adjacent to an upper end of the support tube and fixed thereto, and with the rod extending through the channel and extending downward from a lower end of the support tube, creating a gap between the channel and the rod configured to receive a stake in the gap while the stake also extends downward from the lower end of the support tube on the rod.

An embodiment contemplates a stake installation tool comprising: a rod having a tapered lower end and an opposed upper end; a sleeve fixed to the rod around an outer surface of the upper end; a hollow cylindrical support tube having channel extending therethrough, with the sleeve mounted within the channel adjacent to an upper end of the support tube and fixed thereto, and with the rod extending through the channel and extending downward from a lower end of the support tube, creating a gap between the channel and the rod configured to receive a stake in the gap while the stake also extends downward from the lower end of the support tube on the rod; and a handle mounted on the upper end of the support tube.

An advantage of an embodiment is that stakes can be relatively easily and quickly installed partially in the ground without breaking the stakes during insertion. Such quick and easy installation makes marking areas for snow removal or other uses more convenient, thus assisting those in the snow removal or other businesses where marking of areas with stakes is desired. Additionally, less expensive hollow snow stakes may be employed, thus saving money, particularly for commercial snow removal operations where many stakes are distributed at multiple properties.

DETAILED DESCRIPTION

Figure 2:
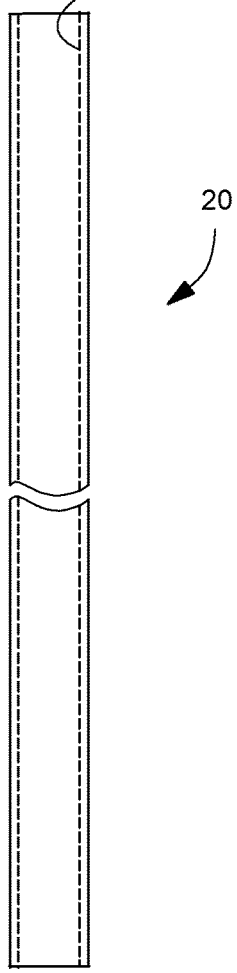
FIG. 2 is a side view of a snow stake.

FIG. 2 illustrates a non-limiting example of a snow stake 20 that may be employed with a snow stake installation tool 22. The snow stake 20 is hollow, having a bore 24 that is sized to conveniently mate with the installation tool 22.

FIGS. 1 and 2-9 illustrate various portions of the installation tool 22, which includes a cylindrical hollow sleeve 26 having a passage 28 extending therethrough, and a cylindrical rod 30 having an outer diameter that is essentially the same diameter as the passage 28. The rod 30 may have a lower end 31 that tapers narrower toward a rounded or pointed end shape in order to ease its insertion into the ground. The installation tool 22 also includes a cylindrical hollow support tube 32 having a channel 34 extending therethrough, and a cylindrical hollow handle 36 having a duct 38 extending therethrough and an aperture 40 through a side of the handle 36.

Figure 8:
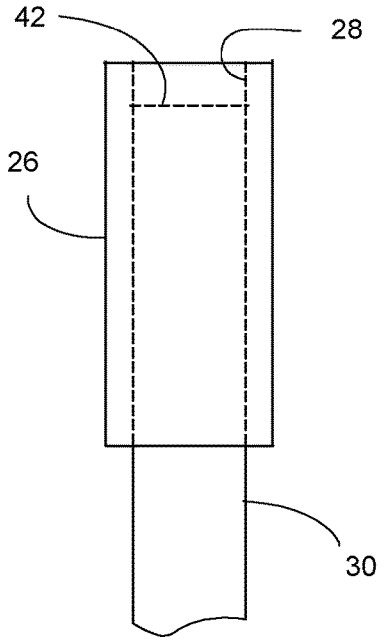
FIG. 8 is a side view of a portion of the rod inserted into the sleeve.

The installation tool 22 may be assembled by telescopically sliding an upper end 42 of the rod 30 into the passage 28 of the sleeve 26, as best seen in FIG. 8. The rod 30 may be secured to the sleeve 26, for example, by employing a press fit between the two components or by welding, as desired.

Figure 9:
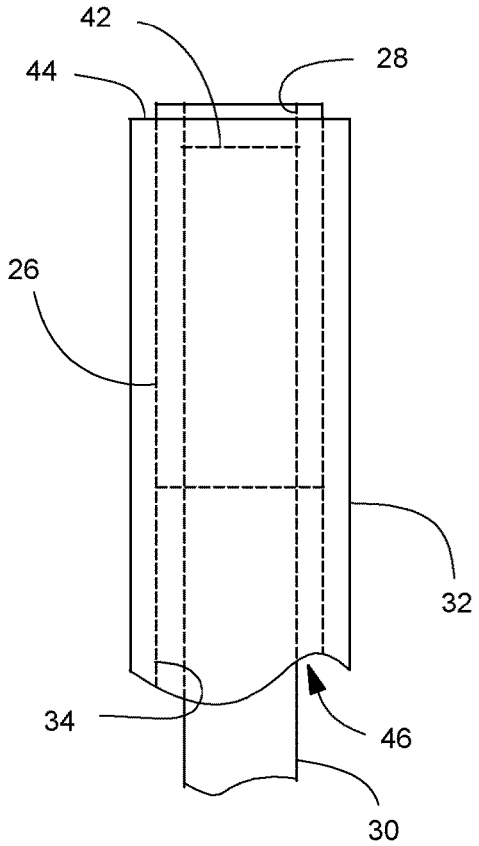
FIG. 9 is side view of a portion of the support tube, with the rod and sleeve inserted therein.

After securing the rod 30 to the sleeve 26, the lower end 31 of the rod 30 is telescopically slid into the channel 34 of the support tube 32, and then the sleeve 26 and rod 30 are slid into the channel 34, as best seen in FIG. 9. The support tube 32 may be secured to the sleeve 26, for example, by employing a press fit between the two components or by welding, as desired.

Figure 1:
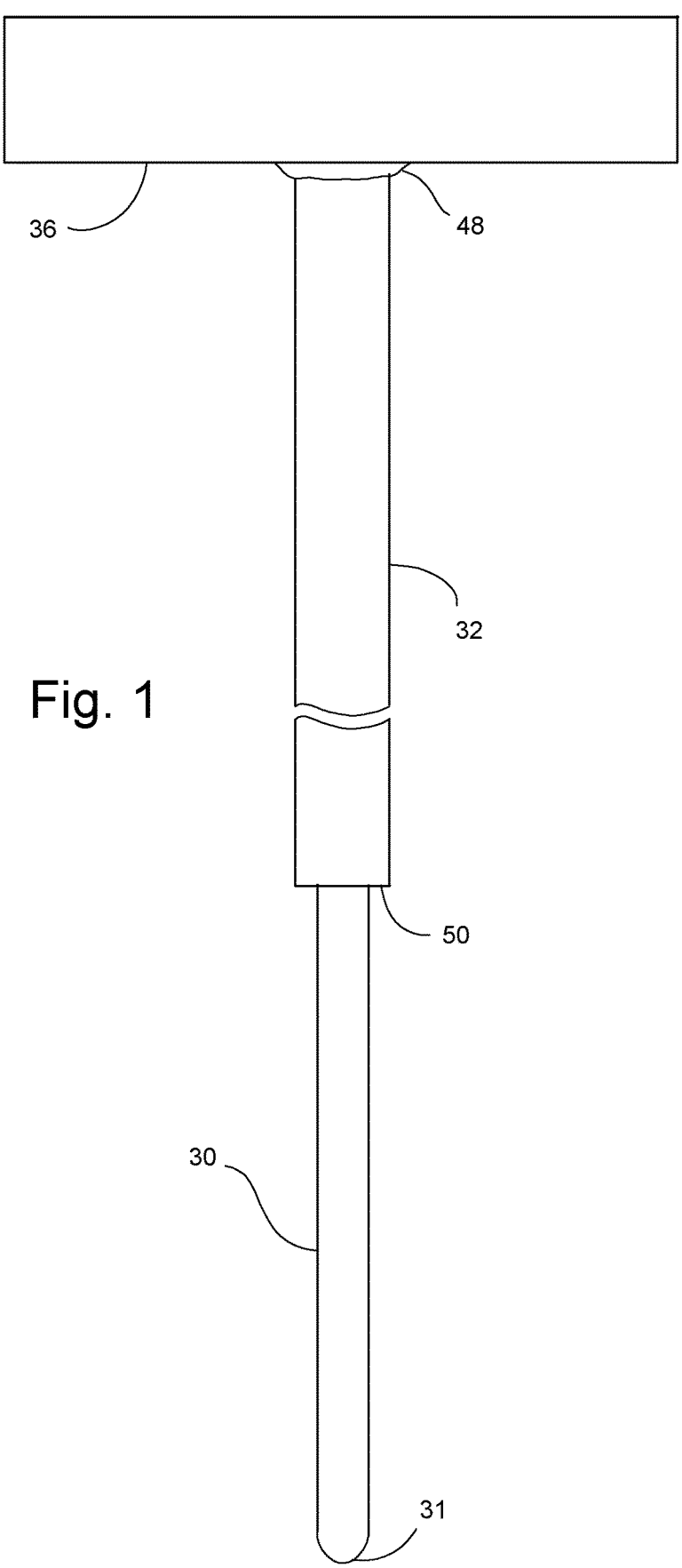
FIG. 1 is a side view of a snow stake installation tool.
Figure 3:
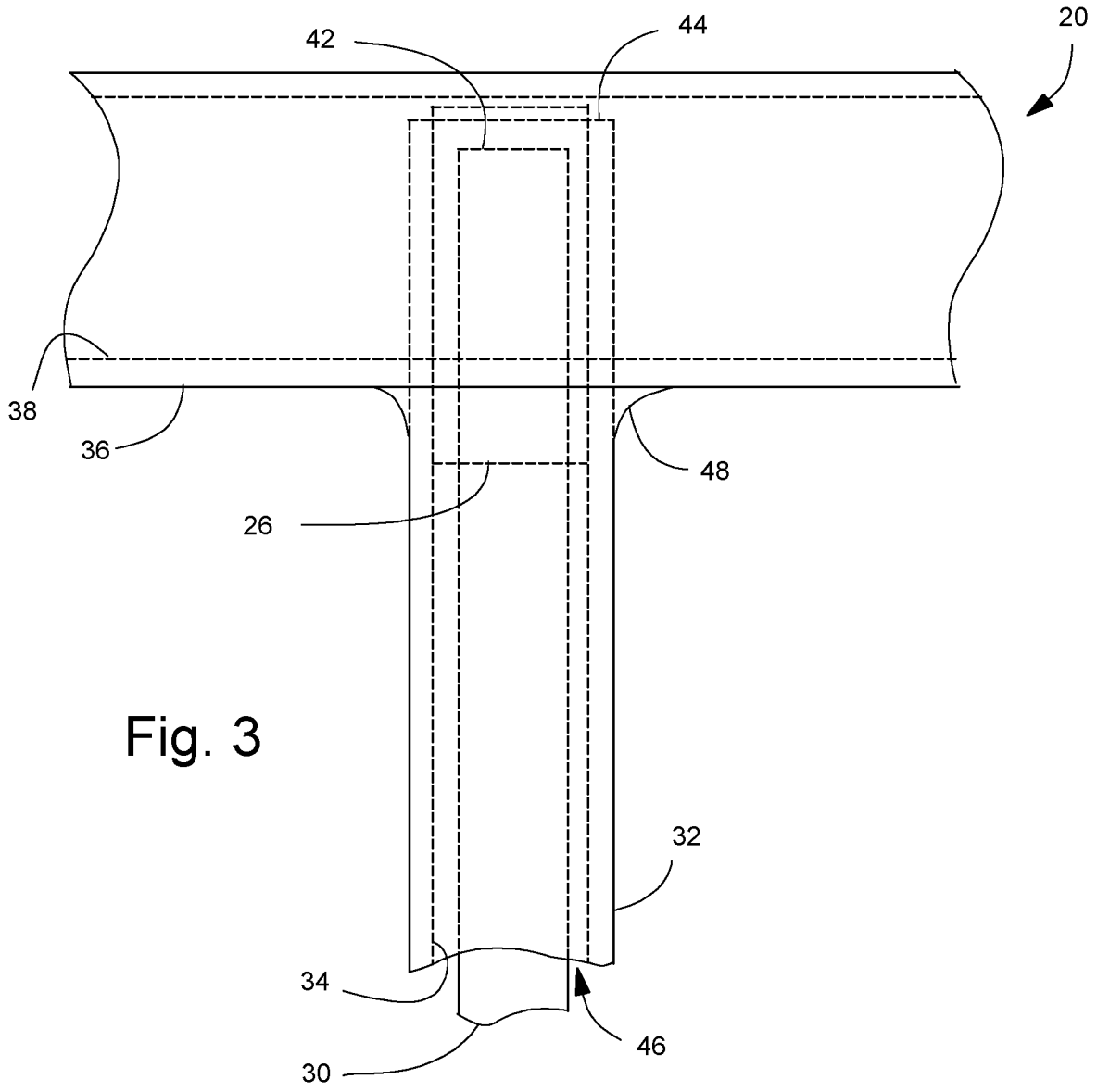
FIG. 3 is a side view of a portion of the installation tool of FIG. 1, with hidden lines shown to illustrate the assembly of the components.
Figure 4:
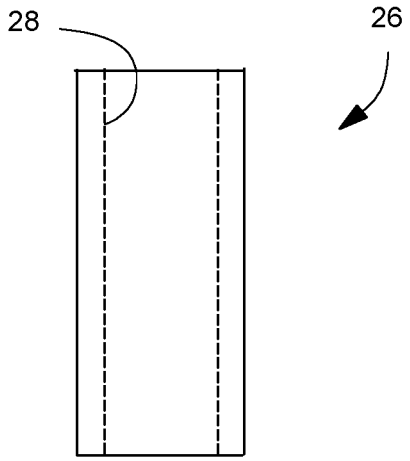
FIG. 4 is a side view of a sleeve.
Figure 5:
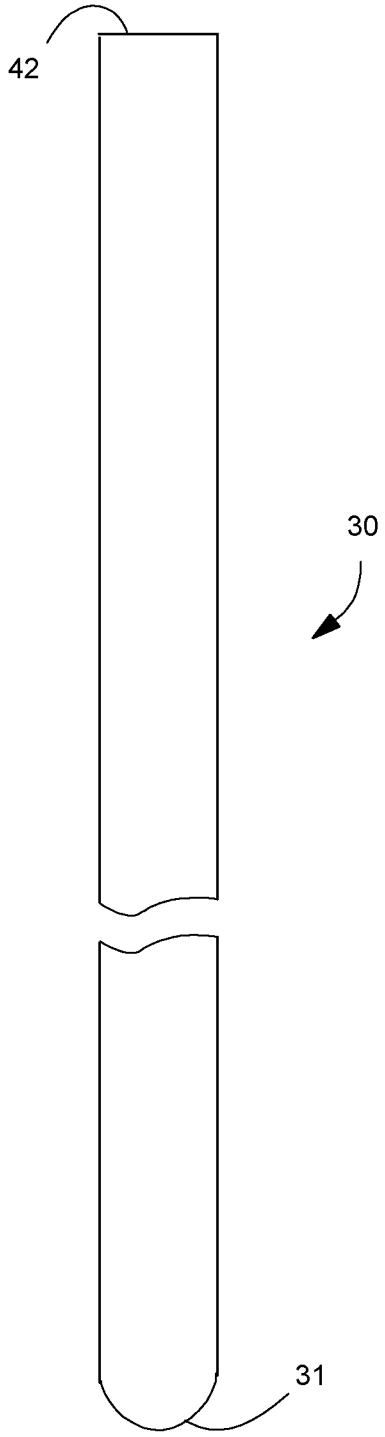
FIG. 5 is a side view of a rod.
Figure 6:
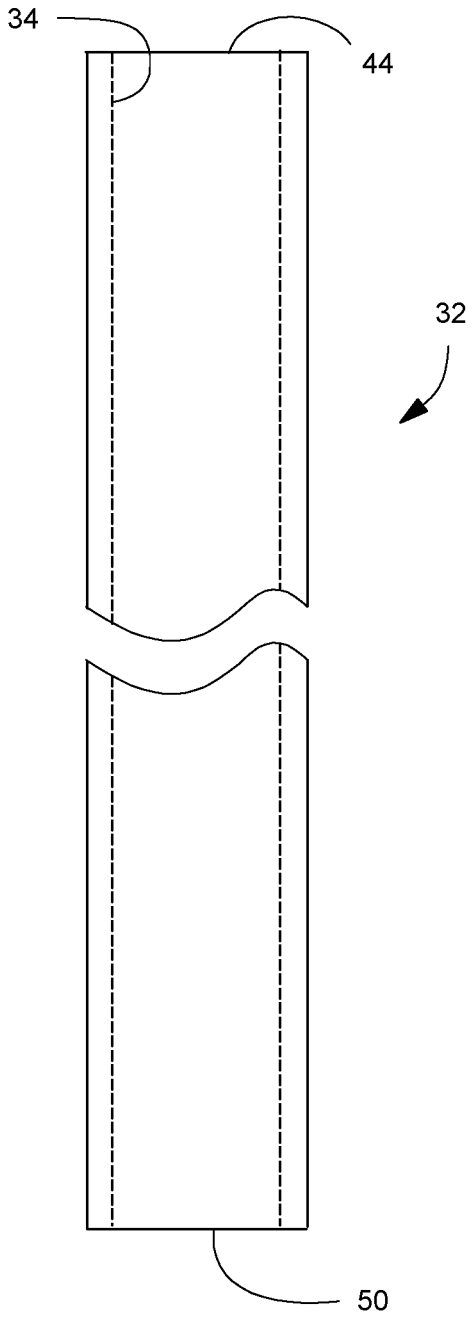
FIG. 6 is a side view of a support tube.
Figure 7:
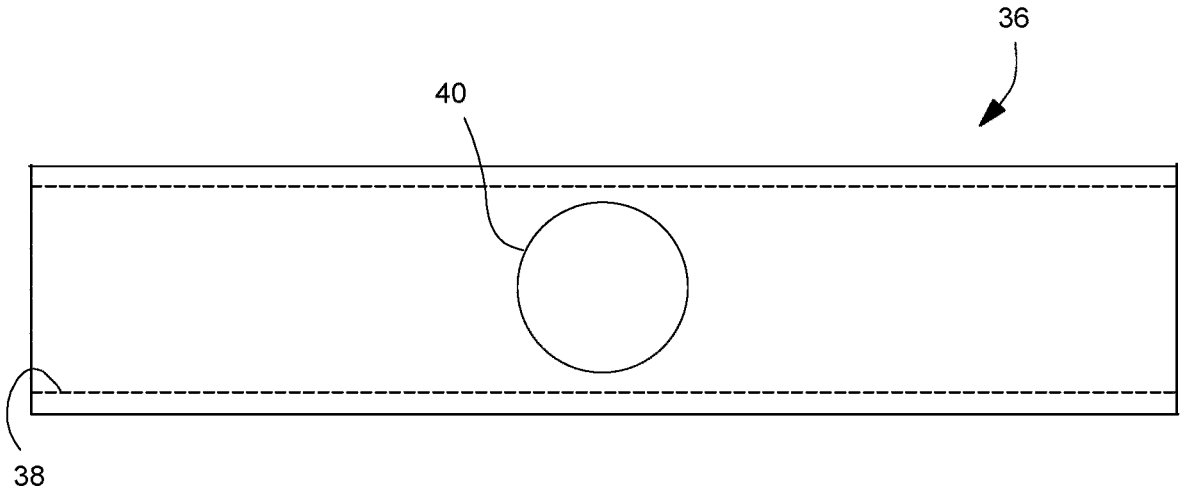
FIG. 7 is a plan view looking up at a bottom of a handle.

After securing the support tube 32 to the sleeve 26, and hence the rod 30, an upper end 44 of the support tube 32 may be slid into the aperture 40 in the handle 36, as best seen in FIG. 3. The handle 36 may be secured to the support tube 32 with, for example, a weld 48 around the circumference of the aperture 40. The completed assembly of the installation tool 22 is best seen in FIG. 1. The various components of the installation tool 22 may be made of, for example steel, although other materials may be employed instead if so desired.

One will note that the diameter of the rod 30 is smaller than the diameter of the channel 34 in the support tube 32, creating a cylindrical shaped gap 46, best seen in FIGS. 3 and 9. The diameter of the rod 30 may be sized to be just smaller than the bore 24 in the snow stake 20, with the diameter of the channel 34 in the support tube 32 sized to be just larger than the outer diameter of the snow stake 20. As a result, a snow stake 20 may be easily and quickly telescopically slide onto the lower end 31 of the rod 30 and up into the channel 34 of the support tube 32 until it reaches the sleeve 26, thereby providing support to the snow stake 20 while being installed into the ground.

The following are non-limiting examples of possible dimensions for the various components of the installation tool 22. If one wishes to install thirty-six inch stakes 20, for example, then the rod 30 may be about thirty-eight inches long and have a diameter of 19/64 inch; the support tube 32 may be about thirty-four inches long, having an outside diameter of 9/16 inch and a diameter of 27/64 inch for the channel 34; the sleeve 26 may be about one inch long, having an outside diameter of 7/16 inch and a diameter of 19/64 inch for the passage 28; and the handle 36 may be about four inches long, having an outside diameter of 7/8 inch, a diameter of 27/64 inch for the duct 38, and an aperture diameter of 19/32 inch. The rod 30, then, extends about four inches past the lower end 50 of the support tube 32. This allows for the snow stake 20 to readily telescopically slide all of the way onto the rod 30 while still extending out of the gap 46 past the lower end 50 of the support tube 32.

As another example of possible dimensions for the installation tool 22 sized for installing twenty-six inch snow stakes 20, the dimensions may be generally the same but with the length of the rod 30 shortened to twenty-eight inches and the length of the support tube 32 shortened to twenty-three inches. Of course, other sizes of snow stakes and other sizes of the installation tool may be employed as well, if so desired.

The installation of the snow stake 20 employing the installation tool 22 may be as follows. One telescopically slides the snow stake 20 onto the lower end 31 of the rod 30 and slides the snow stake 20 into the gap 46 until the snow stake 20 abuts the sleeve 26. One then locates the lower end 31 of the rod 30 above the ground where one wishes to mount the snow stake 20, and then pushes downward on the handle 36 to cause the lower end 31 of the rod 30 to push into the ground the desired distance. While pushing down on the handle 36 to drive the rod 30 into the ground, one may use the lower end 50 of the support tube 32 as a guide to determine how deep the snow stake 20 has been driven into the ground. Upon reaching the desired depth, one pulls straight upward on the handle 36 to remove the installation tool 22 from the ground while leaving behind the snow stake 20.

While certain embodiments of the present invention have been described in detail, those familiar with the art to which this invention relates will recognize various alternative designs and embodiments for practicing the invention as defined by the following claims.

The invention claimed is:

1. A stake installation tool comprising:

a rod having a lower end and an opposed upper end;

a sleeve fixed to the rod around an outer surface of the upper end; and a support tube having channel extending therethrough, with the sleeve mounted within the channel adjacent to an upper end of the support tube and fixed thereto, and with the rod extending through the channel and extending downward from a lower end of the support tube, creating a gap between the channel and the rod configured to receive a stake in the gap while the stake also extends downward from the lower end of the support tube on the rod.

2. The stake installation tool of claim 1 further including a handle mounted on the upper end of the support tube.

3. The stake installation tool of claim 2 wherein the handle is a hollow cylinder and includes an aperture through which the upper end of the support tube is inserted, and a weld securing the handle to the support tube.

4. The stake installation tool of claim 2 wherein the lower end of the rod is tapered.

5. The stake installation tool of claim 2 wherein the rod is a solid cylindrical piece, the sleeve is a hollow cylinder fixed around an outer diameter of the rod adjacent to the upper end of the rod.

6. The stake installation tool of claim 5 wherein the support tube is a hollow cylinder, with an outer diameter of the sleeve fixed to the channel.

7. The stake installation tool of claim 6 wherein the lower end of the rod is tapered.

8. The stake installation tool of claim 1 wherein the lower end of the rod is tapered.

9. The stake installation tool of claim 1 wherein the rod is a solid cylindrical piece, the sleeve is a hollow cylinder fixed around an outer diameter of the rod adjacent to the upper end of the rod.

10. The stake installation tool of claim 9 wherein the support tube is a hollow cylinder, with an outer diameter of the sleeve fixed to the channel.

11. A stake installation tool comprising:

a rod having a tapered lower end and an opposed upper end;

a sleeve fixed to the rod around an outer surface of the upper end;

a hollow cylindrical support tube having channel extending therethrough, with the sleeve mounted within the channel adjacent to an upper end of the support tube and fixed thereto, and with the rod extending through the channel and extending downward from a lower end of the support tube, creating a gap between the channel and the rod configured to receive a stake in the gap while the stake also extends downward from the lower end of the support tube on the rod; and a handle mounted on the upper end of the support tube.

12. The stake installation tool of claim 11 wherein the handle is a hollow cylinder and includes an aperture through which the upper end of the support tube is inserted, and a weld securing the handle to the support tube.

13. The stake installation tool of claim 12 wherein the rod is a solid cylindrical piece, the sleeve is a hollow cylinder fixed around an outer diameter of the rod adjacent to the upper end of the rod.

14. The stake installation tool of claim 11 wherein the rod is a solid cylindrical piece, the sleeve is a hollow cylinder fixed around an outer diameter of the rod adjacent to the upper end of the rod.

* * * * *